United States Patent [19]

Güttinger

[11] Patent Number: 4,715,797

[45] Date of Patent: Dec. 29, 1987

[54] ROTARY-PISTON DISPLACEMENT MACHINE

[75] Inventor: Heinrich Güttinger, Wettingen, Switzerland

[73] Assignee: BBC Brown, Boveri & Company, Ltd., Baden, Switzerland

[21] Appl. No.: 854,619

[22] Filed: Apr. 22, 1986

[30] Foreign Application Priority Data

Apr. 26, 1985 [CH] Switzerland ..... 1780/85

[51] Int. Cl.[4] ..... F04C 18/04; F04C 23/00; F04C 29/04

[52] U.S. Cl. ..... 418/55; 418/59; 418/60; 418/101

[58] Field of Search ..... 418/55, 58–60, 418/101

[56] References Cited

U.S. PATENT DOCUMENTS

| | | | |
|---|---|---|---|
| 1,041,721 | 10/1912 | Ball | 418/59 |
| 1,209,204 | 12/1916 | Richards | 418/101 |
| 4,192,152 | 3/1980 | Armstrong et al. | 418/55 |
| 4,424,010 | 1/1984 | McCullough | 418/60 |
| 4,526,521 | 7/1985 | Sudbeck et al. | 418/55 |

FOREIGN PATENT DOCUMENTS

| | | | |
|---|---|---|---|
| 2338825 | 3/1974 | Fed. Rep. of Germany | 418/55 |
| 3138585 | 7/1983 | Fed. Rep. of Germany | 418/55 |
| 55-112892 | 9/1980 | Japan | 418/58 |

*Primary Examiner*—John J. Vrablik

*Attorney, Agent, or Firm*—Burns, Doane, Swecker & Mathis

[57] ABSTRACT

In a rotary-piston displacement machine, as is suitable, for example, for supercharging internal combustion engines, having at least two spiral-like delivery chambers in a stationary housing and spiral-like displacers engaging therein which execute a circulating, torsion-free movement with respect to the delivery chambers, the displacers are arranged on an eccentrically driven, disk-shaped rotor. The rotor is driven via a shaft centrally arranged in the inside of the housing. The two spirals run centro-symmetrically to one another in such a way that their suction-side ends are arranged around the drive bearings and at the same time cool the latter with fresh air. The air is delivered outwards from the inside of the housing, as a result of which heat dissipation of the outer housing parts during compression is provided for, which housing parts are provided with cooling ribs.

6 Claims, 4 Drawing Figures

ROTARY-PISTON DISPLACEMENT MACHINE

FIELD OF THE INVENTION

The invention relates to a rotary-piston displacement machine for compressible media.

BACKGROUND OF THE INVENTION

A displacement machine of this type, the principle of which is known from German Patent Specification No. 2,603,462 C2, is suitable for supercharging an internal combustion engine, because its remarkable feature is a substantially pulsation-free delivery of the working medium comprising for example, air or an air-fuel mixture. During the operation of spiral superchargers of this type, crescent-shaped working chambers are enclosed along the delivery chamber between the displacer and the two peripheral walls of the delivery chamber. These working chambers move from the inlet through the delivery chamber toward the outlet. At the same tme, their volume is reduced to an increasing extent as the pressure of the working medium is correspondingly raised.

A machine of the type mentioned at the outset is known from German Patent Specification No. 3,141,525 A1. In the disclosed compressor, two displacers attached on a rotor intermesh. The delivery chambers pertaining to them in the stationary housing in each case run from an inlet chamber, provided at the outer periphery of the housing, to an outlet chamber which is provided at the inner periphery of the housing and through which the compressed working medium is discharged. The centrally arranged drive shaft for the rotor, together with a part of the shaft mounting and the rotor bearings, are also accommodated inside the housing. The hot, compressed air flows around these parts and therefore they are inaccessible to cooling. In particular, there is no longer any space available for accommodating cooling chambers as are known, for example, from the above-mentioned German Patent Specification No. 2,603,462 C2 and which also need to be connected to a separate cooling circuit.

It is therefore the object of the present invention to create a displacement machine of the type mentioned at the outset in which heat dissipation can take place during compression.

SUMMARY OF THE INVENTION

This is achieved according to the invention where the at least two spiral-like delivery chambers, without the need for a common instantaneous center, are arranged centrosymmetrically to one another, and the inlet-side ends of the delivery chambers are arranged around the drive mounting of the rotor.

An advantage of the invention is that the drive bearings are now located in the suction area of the spirals and are therefore cooled with fresh air. This is an important precondition for maintenance-free or at least low-maintenance bearings. On the other hand, an access of cooling medium to the hot part of the spirals, which access is favorable for the heat dissipation during compression, is achieved as a result of the spiral arrangement. Thus, if it is intended to use the machine as a supercharger for combustion engines, separate recooling of the supercharged air can be dispensed with.

For this purpose, the housing is expediently provided all round with cooling ribs.

BRIEF DESCRIPTION OF THE DRAWINGS

An exemplary embodiment of the invention is shown in the drawing, in which.

DETAILED DESCRIPTION OF THE INVENTION

The machine shown at approximately 80% full size is equipped with two delivery chambers each per rotor side. The flow direction of the working medium, for example air, is indicated by arrows.

For an explanation of the mode of operation of the compressor, which is not the subject matter of the invention, reference is made to the above-mentioned German Patent Application No. 2,603,462 C2. Only the machine construction necessary for understanding the invention and the process sequence are briefly described below.

Figure 3:
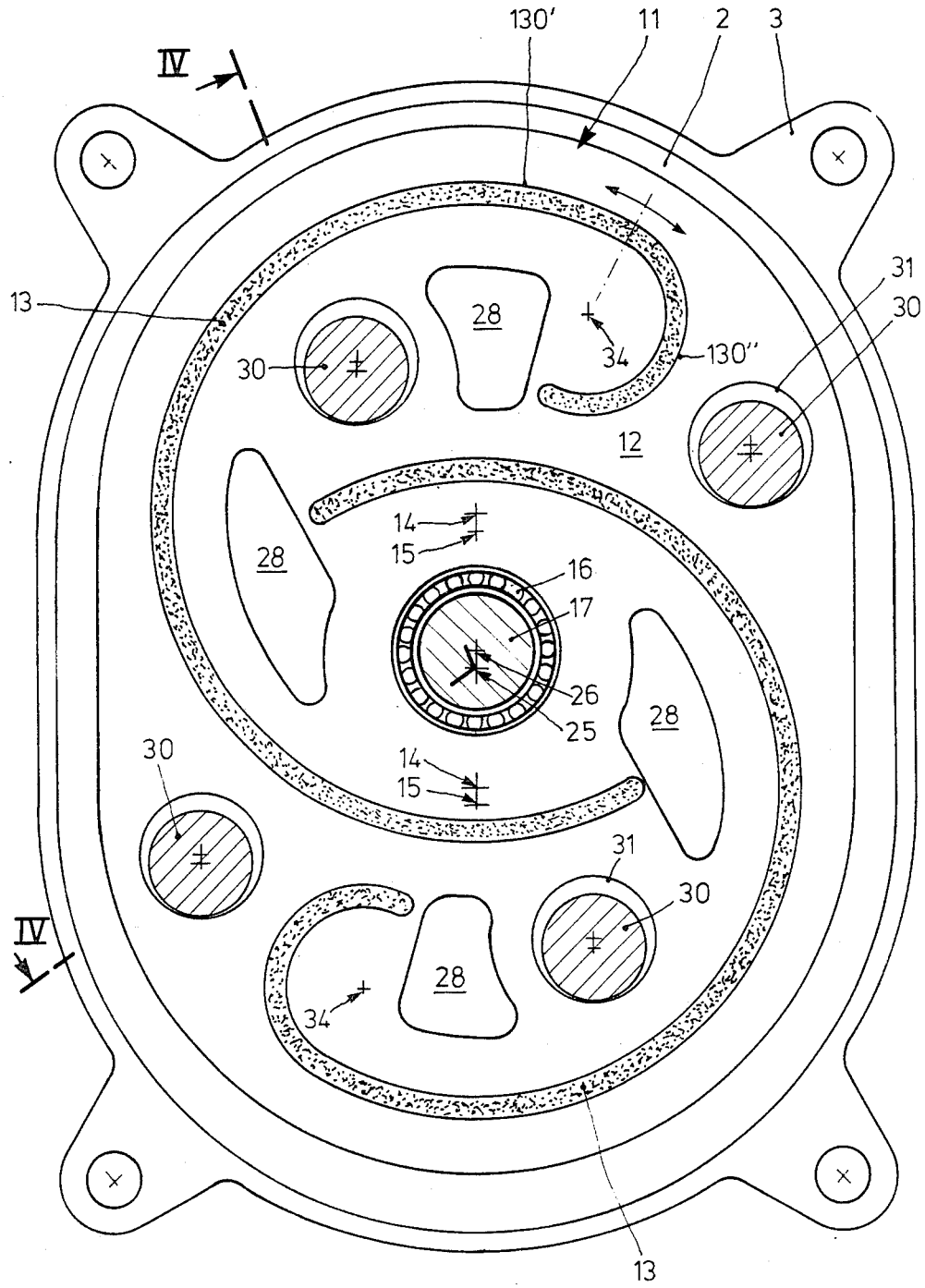
FIG. 3 shows a cross-section in the plane of the rotor disk.
Figure 4:
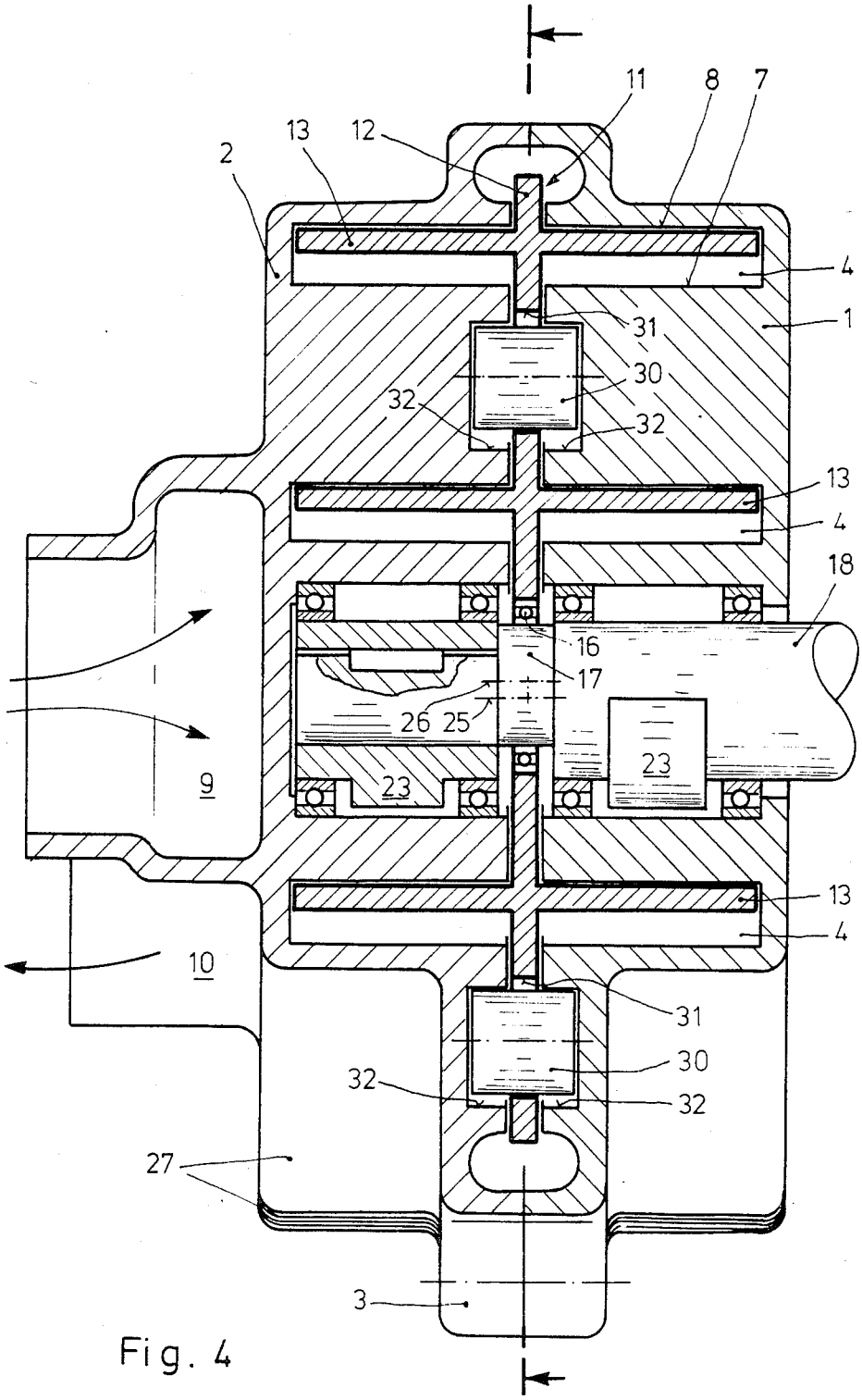
FIG. 4 shows a longitudinal section along section line IV—IV in FIG. 3.

To provide a better overview, the rotor sectional surface shown in FIG. 3 is not hatched, but the nonsectioned spiral-like displacers are shown dotted.

Figure 2:
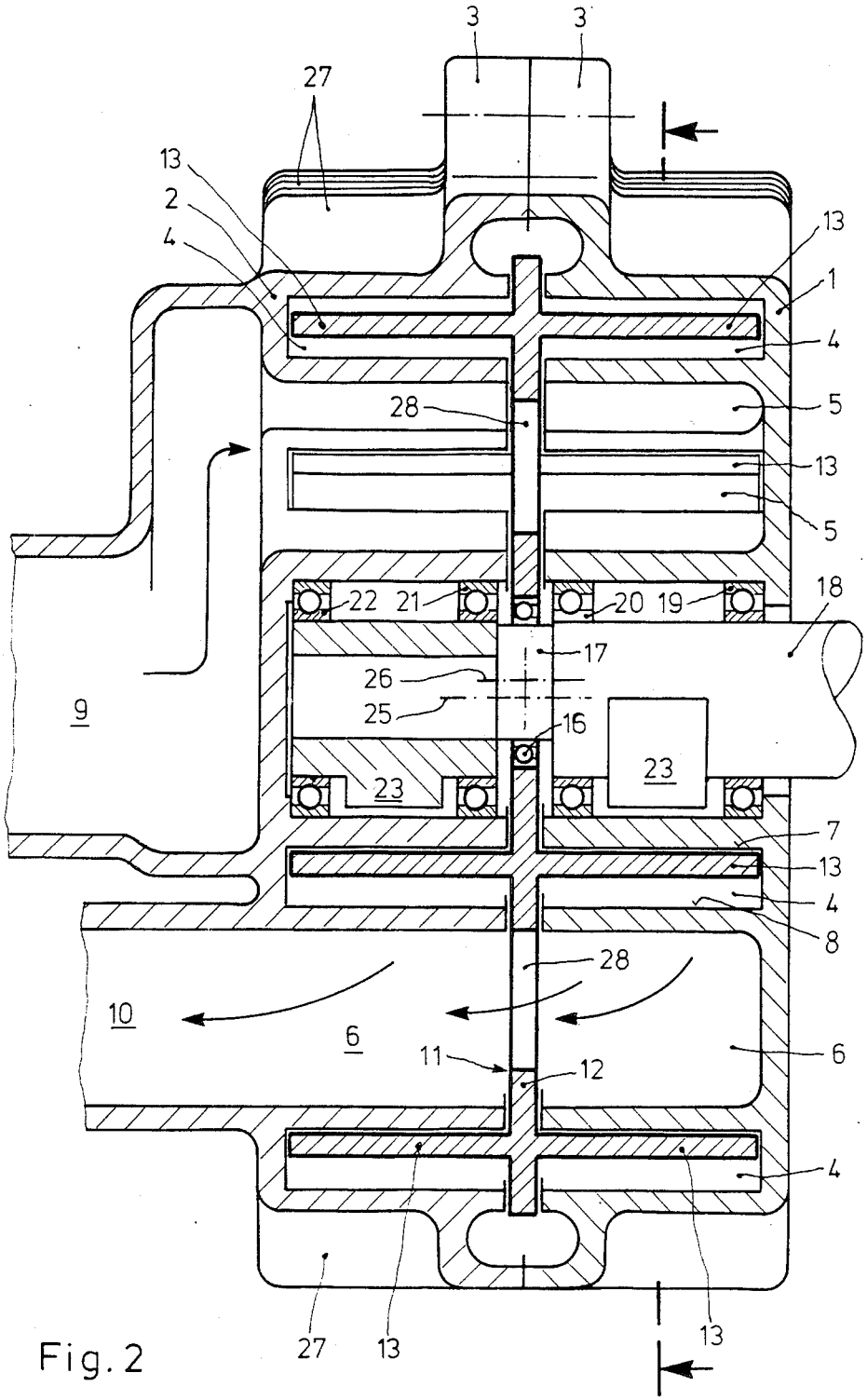
FIG. 2 shows a longitudinal section along section line II—II in FIG. 1.

The stationary housing is made up of the partial housing 1 on the drive side and the partial housing 2 on the air side which are bolted to one another via several flanges 3 attached to the housing periphery. The two delivery chambers 4 are incorporated into the housing parts in the manner of a spiral-shaped slot. These delivery chambers in each case run from an inlet 5 arranged at the outer spiral end to an outlet 6 arranged at the inner spiral end. The two inlets 5 and the outlets 6 respectively communicate with one another in a manner not shown and are connected in each case with an air intake 9 and an air discharge 10 respectively, arranged at the partial housing 2 on the air side (FIG. 2).

The delivery chambers 4 have parallel peripheral walls 7 and 8 which are arranged at a uniform distance from one another and comprise a spiral of more than 360°. The spiral is made up of two portions which are described with reference to the outer peripheral wall 8 of the lower spiral in FIG. 1.

First, an initial portion 40' in the form of a circular arc encompasses less than 360°. In the present case, this initial circular arc, with its center 15 encompasses an angle of about 240° and starts at the inlet-side end of the delivery chamber 4. At the outlet-side end of the delivery chamber 4, a second portion 40'' adjoins continuously which is also in the shape of a circular arc having the center 33 and which here encloses an angle of about 180°. The radius of curvature of the second portion 40'' is substantially smaller than that of the initial portion 40'. The entire second portion 40'' thereby finds space between the outlet-side end of the initial portion 40' and the center 15 of the latter.

Figure 1:
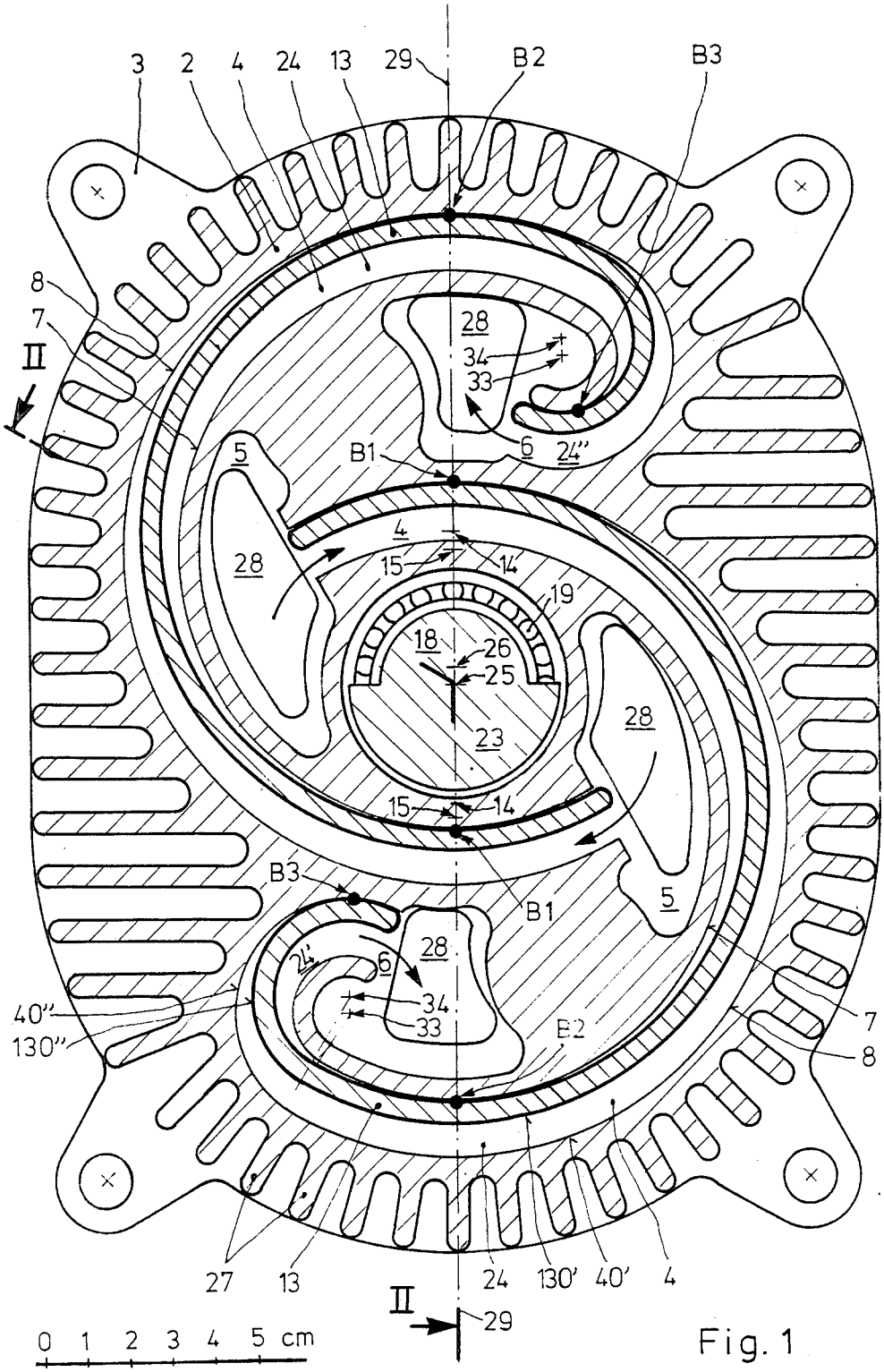
FIG. 1 shows a cross-section through the displacement machine in the plane of the delivery chambers.

The disk-shaped rotor is designated as a whole as 11. Provided on both sides of the disk 12 are displacers 13 which run in a spiral shape and are arranged as band-shaped strips on the disk. These displacers 13 are held between the peripheral walls 7 and 8 of the delivery chambers 4. Their curvature is of such a size that they at the same time almost touch the inner peripheral walls 7 and the outer peripheral walls 8 at several points B1, B2 and B3. For this purpose, the centers 14 of the two displacers 13 are eccentrically offset relative to the centers 15 of the two delivery chambers 4 (FIG. 1). Of course, the displacers 13 must have the same geometry as the delivery chambers; that is, they must form a spiral which consists of two circular portions 130′ and 130″, has the centers 14 and 34 and encompasses more than 360°.

With respect to the delivery chambers, the displacers 13 and therefore the rotor 11 are mounted and guided so as to execute a revolving, torsion-free movement. For this purpose, the rotor is arranged on an eccentric disk 17 by means of a ball bearing 16.

This eccentric disk sits on a drive shaft 18 which in turn is mounted in the stationary housing in ball bearings 19, 20, 21 and 22. The drive of the shaft 18, normally effected via a V-belt pulley, is not shown. To balance the inertia forces developing during the eccentric drive of the rotor 11, counterweights 23 are arranged on the drive shaft between the bearings 19 and 20, and 21 and 22 respectively.

During operation of the machine, each of the displacer points follows a circular movement as a result of the eccentric drive of the disk-shaped rotor featuring the displacers, with this circular movement being defined by the peripheral walls of the delivery chambers. As a result of the repeated, alternating approach of the displacers toward the inner and outer peripheral walls, crescent-shaped working chambers 24 which enclose the working medium are obtained on both sides of the displacers. These working chambers 24, as a result of the eccentric movement, are pushed forward through the delivery chambers toward the respective outlet 6. At the same time, the volume of these working chambers is reduced and the pressure of the working medium correspondingly increases. At actual size and in the case of the sprial geometry and the eccentricity shown in the figures, a delivery volume of about 130 liters per second with a pressure ratio of $p_{discharge}$ to $p_{intake}$ of about 1.5 can be achieved with air as the working medium and at a drive shaft speed of 12,500 rev/min.

To this extent, displacement machines and drives suitable for them are known, with the limitation that the initial portion in all previous spiral forms enclosed an angle of about 360°.

According to the invention, the two spirals of each disk side and each partial housing respectively are now arranged centrosymmetrically to one another, with the centers 14 and 15 of the initial spiral portions 40′ and 130′ not coinciding with the axis 25 of the drive shaft 18 or respectively the center axis 26 of the eccentrically offset rotor 11. Only the center of symmetry of the delivery chambers 4 is located in the drive axis 25, and consequently the center of symmetry of the displacers 13 is located in the eccentric axis 26. The spirals are now arranged in such a way that the inlet-side ends of the initial spiral portions 40′ and 130′ are arranged around the drive mounting of the rotor. They are interconnected in such a way that the shaft bearings 19 to 22 are located all around in the suction area and accordingly are cooled with fresh air. The centers 14 and 15 of the initial spiral portions 40′ and 130′ are located in an approximately central position between the machine axis and the outlets 6, which results in a spiral configuration which saves considerable space.

The air is therefore delivered from the inside to the outside, as a result of which the machine parts heated up during compression are made accessible to a very simple means of cooling. For this purpose, the outer peripheral walls 8 of the hot spiral portions are provided throughout with cooling ribs 27. The two housing parts 1 and 2 are expediently equipped with such cooling ribs over their entire periphery (FIG. 1).

In order to lead the drawn-in working medium from the air-side to the drive-side delivery chambers or to dissipate it in the reverse directions, the rotor disk 12 is provided with openings 28 of appropriate form in the area of the inlets 5 and the outlets 6 (FIG. 3).

Because of the centrosymmetric spiral arrangement, the compressed air in the discharge 10 is in the same state in all cases, because this is always a mixture from an inner working chamber 24′ and an outer working chamber 24″. The eccentric disk 17 is aligned on the drive shaft 18 in such a way that, in a particular position, the points B1 and B2 (of the two displacers 13 with the peripheral walls of the delivery chambers 4), the centers 14 and 15 of the two spirals, and also the axes 25 and 26 of the drive shaft and the eccentric disk are located on a common line 29—as in the example shown in FIG. 1. In this position, the displacer forms the narrowest gap with the outer peripheral wall 8 in the upper spiral at point B2, but forms the narrowest gap with the inner peripheral wall 7 of the delivery chamber 4 in the lower spiral at point B2.

Moreover, the centrosymmetric spiral arrangement balances the tilting movement which would develop during operation with a single spiral with a drive mounting shifted from the center. This has the advantage that the device required for the translatory guidance of the rotor 11 can be of simple design.

The rotor is guided by means of four free-running roller pins 30 which are distributed over the periphery of the machine. In this connection, it is not necessary for the roller pins either to be located on the same pitch circle or to have the same angular distances from one another. This flexibility enables the guidance device to be accommodated in space-saving manner without impairing the course of the spirals. A roller pin rolls in each case in a bore 31 of the rotor and in a bore 32 in both housing parts 1 and 2, with bore 32 is adapted to and is the same size as the bore 31. To ensure that the roller pin is always in contact, its diameter is to be made smaller than the diameter of the housing bores 32 by the amount of eccentricity between the eccentric axis 26 and the drive axis 25. The roller pin position shown in FIG. 3 corresponds to the displacer position in FIG. 1 in which the upper displacer almost touches the outer peripheral wall 8 of the delivery chamber 4 at point B2.

The invention is not of course limited to the machine shown and described. As a departure from the spiral shape shown, which here consists of two circular arcs, classical spiral shapes, such as, for example, the Archimedes spiral or even involutes, can of course be used. Care need only be taken to ensure that the radius of curvature of the second portion is always substantially smaller than that of the initial portion.

Moreover, a ventilator which pressure-cools the cooling ribs during operation could for example be mounted onto the drive shaft outside the housing. This ventilator might also be arranged on the air side of the housing side if, for example, the drive shaft were guided through the partial housing 2.

What is claimed is:

1. In a rotary-piston displacement machine for compressible media of the type having two stationary delivery chambers which form a spiral in a stationary housing, encompass more than 360° and in each case lead from an inlet to an outlet, and having a spiral displacer allocated to each delivery chamber and engaged into the latter, each displacer forms a spiral and encompasses more than 360°, is arranged as a band-shaped strip on a disk-shaped rotor eccentrically driven relative to the housing, and is mounted and guided with respect to the delivery chambers in order to execute a circulating, torsion-free movement, and wherein the spiral shaped delivery chambers and displacers in each case consist of two portions, with a second portion continuously adjoining the outlet-side end of an initial portion which encompasses less than 360°, the radius of curvature of which second portion is substantially smaller than the minimum radius of curvature of the initial portion, so that the second portion is located between the outlet-side end and the center of the initial portion, the improvement wherein:

the spiral-like delivery chambers are arranged centrosymmetrically to one another in the absence of a common instantaneous center, and the inlet-side ends of the delivery chambers are arranged around a drive mounting for the rotor, the drive mounting being located radially inwardly of the delivery chambers.

2. Machine as claimed in claim 1, wherein a drive axis coincides with the center of symmetry of the delivery chambers and an eccentrically offset center axis of the rotor coincides with the center of symmetry of the displacers.

3. Machine as claimed in claim 1, wherein the housing (27) is provided with cooling ribs (27) preferably arranged over the entire periphery.

4. Displacement machine as claimed in claim 1, in which the rotor is equipped on both sides with displacers, wherein the rotor is provided with openings on both the intake side and the discharge side.

5. Machine as claimed in claim 1, wherein the rotor is guided in the housing via several roller pins, and at the same time in each case one roller pin engages into a bore of the rotor as well as into a housing bore which is adapted to and is the same size as the bore, with the diameter of the roller pins being smaller than that of the housing bores by the amount of the eccentricity between the drive axis and the center axis of the rotor.

6. A rotary-piston displacement machine for compressible media, comprising:

a stationary housing;

a rotor eccentrically driven relative to the housing, said rotor being guided by a drive mounting in the housing;

two spiral-shaped delivery chambers within said housing;

a spiral-shaped displacer arranged within each delivery chambers, said displacers being mounted on said rotor;

an inlet leading to one end of each delivery chamber;

said chambers and inlets being arranged such that the inlets are adjacent to and on opposite sides of the rotor drive mounting;

the drive mounting coincides with the center of symmetry of the delivery chambers;

each chamber and displacer comprises first and second sections, said first sections having a larger radius of curvature than said second sections; and the inlets lead to the first section of the chambers.

* * * * *

UNITED STATES PATENT AND TRADEMARK OFFICE

CERTIFICATE OF CORRECTION

PATENT NO. : 4,715,797

DATED : December 29, 1987

INVENTOR(S) : Heinrich Guttinger

It is certified that error appears in the above-identified patent and that said Letters Patent is hereby corrected as shown below:

On the title page, Item [73] should read

-- [73] Assignee: BBC Brown, Boveri & Company, Ltd., Baden, Switzerland, and Aginfor AG. Fur Industrielle Forschung, Wettingen Switzerland --.

Signed and Sealed this

Third Day of January, 1989

*Attest:*

DONALD J. QUIGG

*Attesting Officer*

*Commissioner of Patents and Trademarks*